US012378826B2

(12) United States Patent
Rohr

(10) Patent No.: US 12,378,826 B2
(45) Date of Patent: Aug. 5, 2025

(54) WIRELINE HEAD WITH MECHANICAL CABLE RELEASE

(71) Applicant: Schlumberger Technology Corporation, Sugar Land, TX (US)

(72) Inventor: William Rohr, Sugar Land, TX (US)

( * ) Notice: Subject to any disclaimer, the term of this patent is extended or adjusted under 35 U.S.C. 154(b) by 0 days.

(21) Appl. No.: 18/836,525

(22) PCT Filed: Apr. 18, 2023

(86) PCT No.: PCT/US2023/018986
§ 371 (c)(1),
(2) Date: Aug. 7, 2024

(87) PCT Pub. No.: WO2023/205178
PCT Pub. Date: Oct. 6, 2023

(65) Prior Publication Data

US 2025/0129675 A1 Apr. 24, 2025

Related U.S. Application Data

(60) Provisional application No. 63/363,129, filed on Apr. 18, 2022.

(51) Int. Cl.
*E21B 17/02* (2006.01)
*E21B 17/06* (2006.01)

(52) U.S. Cl.
CPC ..... *E21B 17/023* (2013.01); *E21B 17/06* (2013.01)

(58) Field of Classification Search
CPC ..... E21B 17/023; E21B 17/06
See application file for complete search history.

(56) References Cited

U.S. PATENT DOCUMENTS 4,237,972 A * 12/1980 Lanmon, II ..... B23D 15/145 166/54.5
2004/0134667 A1* 7/2004 Brewer ..... E21B 17/023 166/242.6
2005/0230115 A1* 10/2005 Rose ..... E21B 17/026 166/301

(Continued)

FOREIGN PATENT DOCUMENTS

WO 2004046497 A1 6/2004

OTHER PUBLICATIONS

Search Report and Written Opinion of International Application No. PCT/US2023/018986 dated Jul. 27, 2023, 12 pages.

(Continued)

*Primary Examiner* — Taras P Bemko
(74) *Attorney, Agent, or Firm* — Jeffrey D. Frantz

(57) ABSTRACT

An improved wireline head and related methods are disclosed. The wireline head can incorporate a release device that allows for a clean cable release while maintaining the portions of the wireline head that were used to retain the cable. For example, the wireline head can include an outer cone and an inner cone configured to trap a portion of a cable, such as armor cabling, between the inner cone and the outer cone. A mechanical link can be positioned within the wireline head, where the mechanical link is configured to separate at a predetermined location such that the cable is freed from the wireline head. A retaining component can be positioned to retain the outer and inner cones within the wireline head after the mechanical link separates.

18 Claims, 4 Drawing Sheets

(56) References Cited

U.S. PATENT DOCUMENTS

| | | | | |
|---|---|---|---|---|
| 2008/0149348 | A1 | 6/2008 | Difoggio et al. | |
| 2016/0053556 | A1 | 2/2016 | Vanegas et al. | |
| 2020/0217148 | A1 | 7/2020 | Massey et al. | |
| 2021/0254776 | A1 | 8/2021 | Tjader | |
| 2021/0285300 | A1* | 9/2021 | Hallundbæk | E21B 23/14 |
| 2021/0301598 | A1* | 9/2021 | King | E21B 17/023 |
| 2022/0145716 | A1* | 5/2022 | Kleinschmit | E21B 17/026 |
| 2023/0115354 | A1* | 4/2023 | Rasmussen | E21B 29/005 166/54.6 |
| 2023/0335938 | A1 | 10/2023 | Rohr | |

OTHER PUBLICATIONS

International Preliminary Report on Patentability of International Patent Application No. PCT/US2023/018986 Dated Oct. 31, 2024, 9 Pages.

* cited by examiner

WIRELINE HEAD WITH MECHANICAL CABLE RELEASE

CROSS REFERENCE PARAGRAPH

This application is a National Stage Entry of International Patent Application No. PCT/US2023/018986, filed Apr. 18, 2023, which claims the benefit of U.S. Provisional Application No. 63/363,129, entitled "WIRELINE HEAD WITH MECHANICAL CABLE RELEASE," filed Apr. 18, 2022, the disclosure of which is hereby incorporated herein by reference.

BACKGROUND

In the oil and gas industry, wireline cables are used to lower downhole tools into a wellbore to perform various services. A wireline cable (also referred to herein as a "wireline" or "cable" herein) can include electrical cabling capable of conveying power and data, to control tools and acquire real-time data from their operation. A wireline cable can also include strengthening elements such as armored cabling that not only protects the wireline but also provides tensile strength for supporting a tool as it is raised or lowered within a wellbore.

A wireline cable is typically terminated both electrically and mechanically via a cable termination. A wireline head is then typically used to contain the cable termination and connect the cable to a downhole tool. A wireline head with cable termination refers to a mechanical and electrical coupling that securely terminates or secures the cable and allows for connection to a tool. Cable termination can include any type of mechanical cable connection and does not imply that the entire cable ends at the termination location-rather, at least some of the cable, such as the portion that carries power and data, can continue past the termination location such that it can interface with a tool as necessary.

A wireline cable typically consists of inner and armor wires which carry the tensile load of the cable. The cable is mechanically terminated using a rope socket which traps these armor wires between cones. These cones are hammered into place and seat on the cable armors via the deformation of the cone or armor materials and friction allowing for the tensile load to be transferred through the rope socket into the wireline head. The cones can come unseated and allow the cable to slip from the rope socket if the cones are not properly set or the rope socket is overused. A threaded cap can be used to trap the cones to prevent them from unseating, but these threaded caps typically prevent a "clean cable release" that allows the cable to separate from the wireline head without any components attached to the cable.

Wireline tools can become stuck, resulting in costly fishing operations and/or abandonment of tools and sections of the well. Release devices are used to increase the likelihood of retrieving tools. Some release devices cause the tool string to separate between tools and allow the wireline cable to separate from the head. A clean cable release is sometimes preferred as it allows the cable to be retrieved from the well without the added risk of the attached components potentially becoming stuck after release and/or damaged at the well head. However, existing solutions that provide for a clean cable release do not retain or trap the rope socket cones. The existing solutions use rope sockets that are more difficult to assemble and more prone to unseating rope socket cones which can result in an unintentional pull-off of the tools from the wireline cable.

As a result, a need exists for a wireline head that provides a clean cable release while providing the benefit of trapping the rope socket cones to reduce the risk of intentional pull-off.

SUMMARY

An improved wireline head and related methods are disclosed. The wireline head can incorporate a release device that allows for a clean cable release while trapping the rope socket cones while the head is in use. For example, the wireline head can include an outer cone and an inner cone configured to trap a portion of a cable, such as armor cabling, between the inner cone and the outer cone. To install the cones, an operator can separate the armor portion of the cable from an interior portion of the cable that transmits power and data. The outer and inner cones can then be forced into place, such as by a hammer or press, such that the cones trap the armor portion of the cable and prevent the cable from releasing. A cap can then be applied to the rope socket to prevent the cones from unseating unintentionally.

To release the cable, excess tension can be applied to the cable. A mechanical link can be positioned within the wireline head, where the mechanical link is configured to separate at a predetermined location and load such that the cable is freed from the wireline head. A retaining component can be positioned within the wireline head to release the cap trapping the cones and unseat the outer and inner cones within the wireline head after the mechanical link separates. The mechanical link can be, for example, a metal collar, a split nut and sleeve, or a spring finger collet and sleeve. Where a sleeve is used, the sleeve can be retained by the retaining component, or another component, within the wireline head, while the split nut or spring finger collet is allowed to slide out of the sleeve. This allows the split nut or spring finger collet to open or expand, releasing tension on the cones and cable for a clean cable release.

In some examples an electric motor inside the wireline head can provide actuation that causes the cable release. For example, an electric motor can actuate a mechanical link to mimic the displacement that would result from breaking the mechanical link. In another example, the electric motor can actuate a sleeve surrounding a split nut or spring finger collet, allowing the device to expand and release its tension on the cones and cable.

A method for releasing a cable from a wireline head using the disclosed wireline head is also provided. The method can include providing the wireline head, applying a tensile load to the cable sufficient to separate the mechanical link, and retrieving the cable from the wireline head. Another example method can include actuating an electric motor rather than applying the tensile load to the cable.

DESCRIPTION OF THE EXAMPLES

Reference will now be made in detail to the present examples, including examples illustrated in the accompanying drawings.

Figure 1:
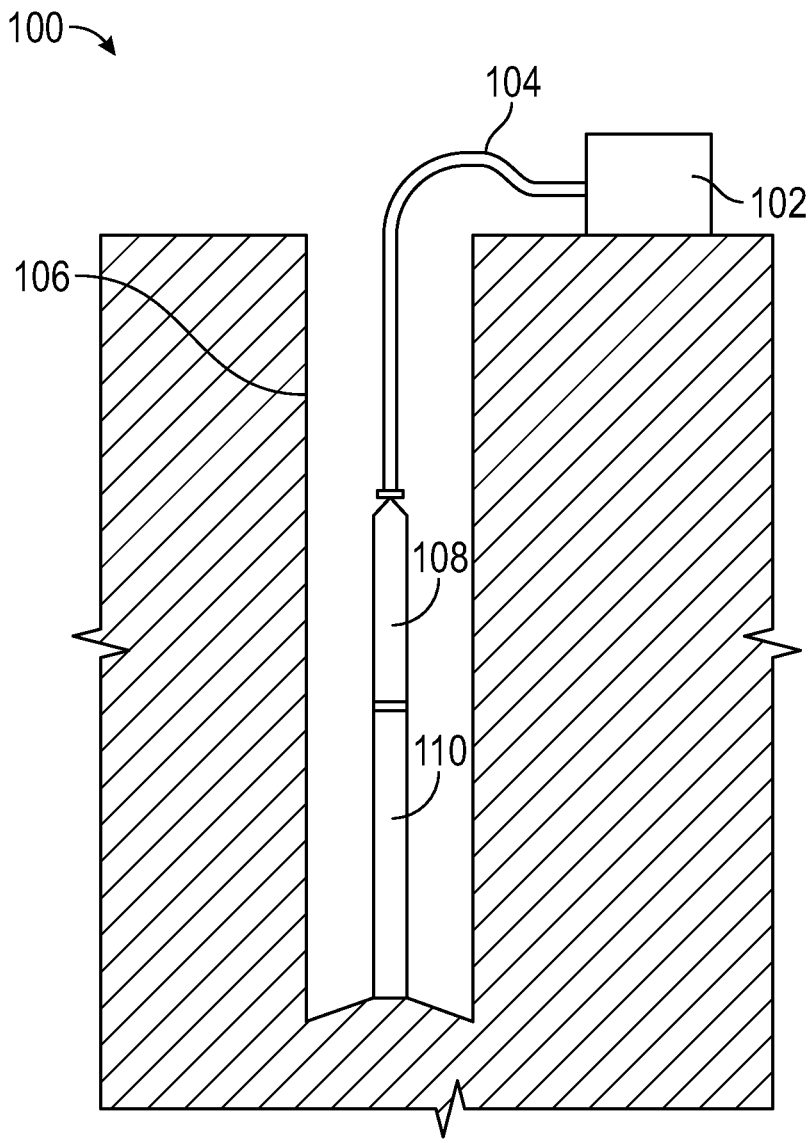
FIG. 1 is an illustration of a generic tool being placed within a wellbore using a wireline connected to the tool by an example wireline head.

FIG. 1 shows a diagram of an example in-field usage environment and associated system 100 for wireline operations, in accordance with embodiments of the disclosure. For example, the system 100 includes wireline surface equipment 102 and an associated wireline cable 104. The wireline surface equipment 102 can include any components necessary to operate a wireline cable 104. For example, the equipment 102 can include mechanical components for controlling the wireline 104, such as a spool or reel upon which the wireline cable 104 is wound, and a motor that rotates the spool or reel to wind and unwind the wireline cable 104. The wireline surface equipment 102 can also include various electrical components, such as a control system. The control system can, for example, control the winding and unwinding of a wireline spool or the operation of a tool 110, either automatically or based on operator input. The control system of the wireline surface equipment 102 can include one or more computing devices, such as a computer, smartphone, or tablet. The equipment 102 can also include a power source that provides power to the wireline 104. The equipment 102 can also send and receive data through the wireline cable 104.

In some examples, wireline cable 104 can include multi-conductor lines and single-conductor lines that can be used with equipment that is inside a wellbore 106. The wellbore 106 can include a hole that is drilled to aid in the exploration and recovery of natural resources, including oil, gas, or water. In some examples, multi-conductor lines can include external armor wires wound around a core of multiple conductors. The conductors can be bound together in a central core, protected by the outer armor wires. The conductors can be used to transmit power to the downhole instrumentation and transmit data to and from the surface equipment 102 (e.g., computers, mobile devices, and the like). In other aspects, the single-conductor cables can be similar in construction to multi-conductor cables but can only have one conductor. In other aspects, single-conductor cables can be used for well construction activities such as pipe recovery, perforating and plug setting as well as production logging and reservoir production characterization.

The wireline cable 104 can be used to physically raise or lower a tool 110 within the wellbore 106, for example by operating the wireline surface equipment 102 to reel the cable 104 in or out. The wireline cable 104 can also provide power and data lines to the tool 110. A wireline head 108 can be used to attach the wireline cable 104 to the tool 110. As explained in more detail with respect to the remaining drawings, the wireline head 108 can include a rope socket that terminates, or secures, the wireline cable 104 within the wireline head 108. The wireline head 108 can also detachably couple to the tool 110, providing a mechanical and electrical connection between the wireline cable 104 and the tool 110.

The wireline cable 104 can be removed from the wireline head 108 by implementing the devices and methods disclosed herein, including those associated with the following disclosure.

Figure 2A:
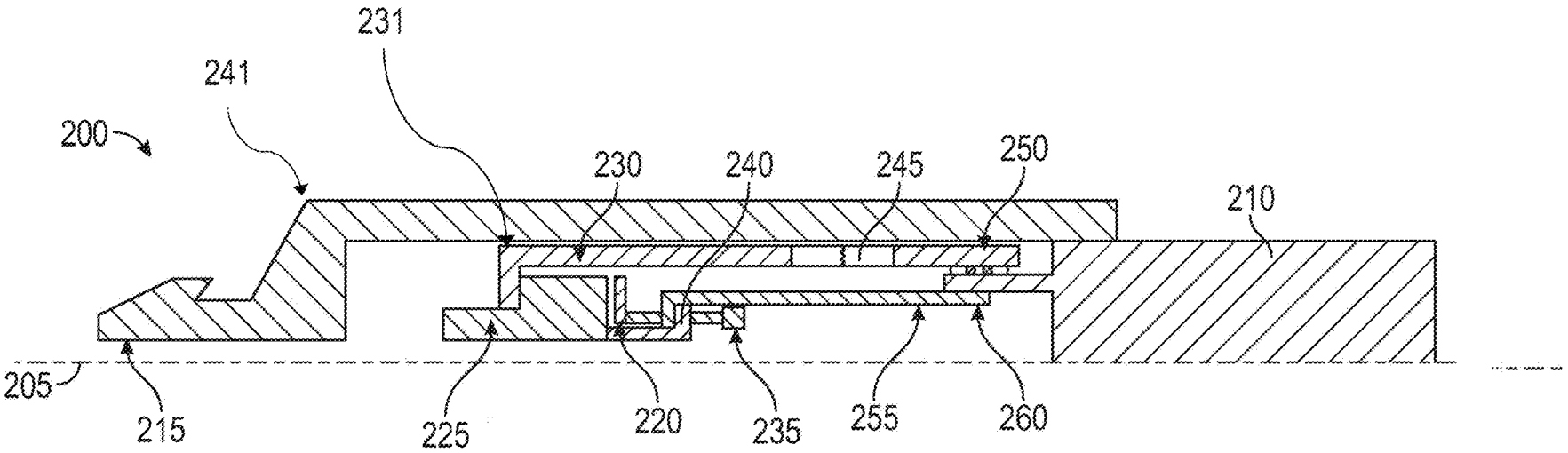
FIG. 2A is an illustration of a wireline head that includes a separable mechanical link.
Figure 2B:
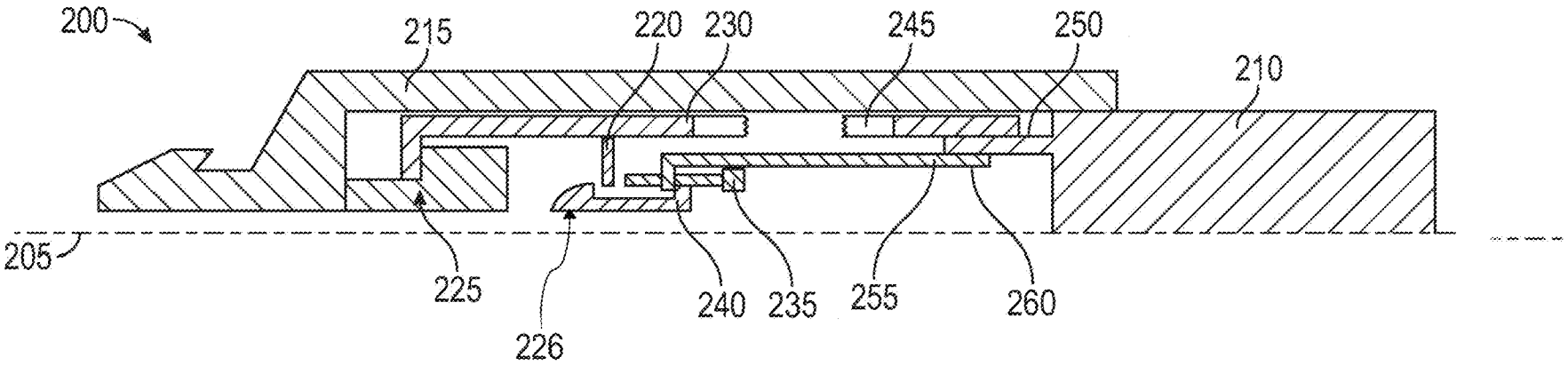
FIG. 2B is an illustration of the wireline head of FIG. 2A with the mechanical link separated.
Figure 3A:
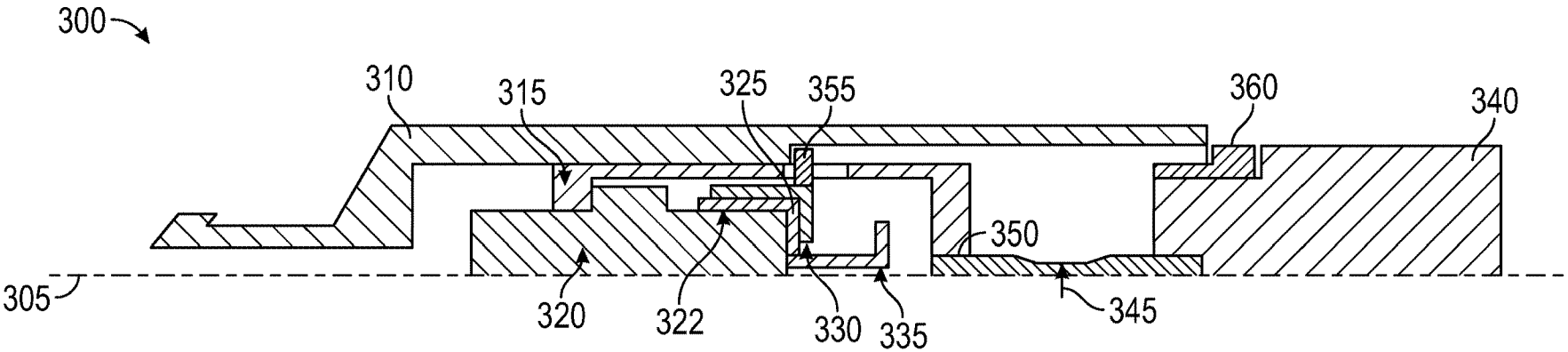
FIG. 3A is an illustration of a wireline head that includes another separable mechanical link that includes a split nut.
Figure 3B:
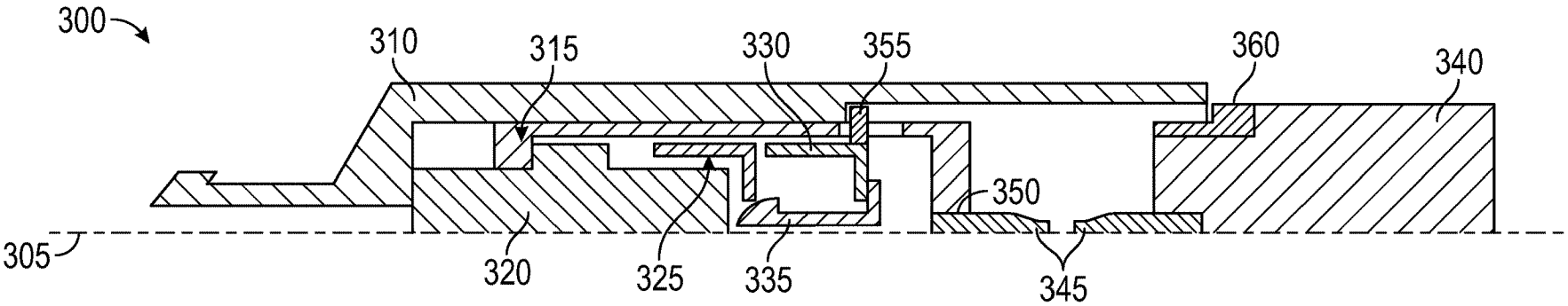
FIG. 3B is an illustration of the wireline head of FIG. 3A with the mechanical link separated.

FIG. 2A provides an illustration of a wireline head 200 that includes a separable mechanical link 231. This drawing, as well as those in FIGS. 2B, 3A, and 3B are depicted as cross-sectional illustrations that include only one half of the cross-sectional view. These drawings include centerlines, such as centerline 205, indicating that the components are mirrored on either side of the centerline 205.

The wireline head 200 includes a main housing 215 that is fixed to a block 210. The block 210 can provide an anchor point that remains fixed with respect to a tool, such that components fixed to the block 210 also remain fixed with respect to the tool. A rope socket 225 is held in place by a separable member 230. In some examples, the rope socket 225 can include one or more cones for trapping portions of a cable, such as strands of armor cabling that have been peeled back from the cable. The rope socket 225 is held in place by a shoulder of the separable member 230.

The inner cone 240 and intermediate cone can be held in place using a friction component, such as a compression plate 220 or jam plate. The compression plate 220 can exert a force on the inner cone 240 to retain the relevant portion of the inner cone 240 within the rope socket 225. The compression plate 220 itself can be held in place with a screw 235 that passes freely through the inner cone 240, via a hole or slot, and threaded into an inner housing 255. The screw 235 can be threaded to the inner housing 255 such that the two components move together, while the inner cone 240 can slide along a portion of the screw 235 length. The screw 235 can exert force on the compression plate 220 to trap the rope socket cones. The inner housing 255 can be threaded to the block 210 at connection point 260. The separable member 230 can also be threaded to the block 210, such as at connection point 260 as shown.

When sufficient tensile force is applied to a cable, which is not shown but is understood to be held in place by the rope socket 225 and associated cones, that force can be mechanically transferred to the block 210 through the rope socket 225 and separable member 230. The separable member 230 can be configured to separate, such as by mechanical failure of the material or an associated fastener, at a tensile load that is lower than a load required to break other components of the wireline head 200. For example, the separable member 230 can break at a weak point 245 shown in FIG. 2B. The separable member 230 can be configured to break at the lower tensile load based on the material type, the shape or thickness of the component, or a combination thereof. The separable member 230 can also include a fastener, such as a pin, that is configured to fail at a predetermined tensile load.

As shown in FIG. 2B, when the separable member 230 breaks, one portion remains fixed to the block 210 while the remaining portion is free to slide uphole (which in the example of FIG. 2B is in a left direction). Based on the separable member 230 sliding left, the rope socket 225 can similarly move in the same direction because the separable member 230 is no longer holding the rope socket 225 in its original position. However, as shown, the portion of the separable member 230 in contact with the rope socket 225 can still retain the rope socket 225 within the wireline head 200 based on the shoulder blocking the rope socket 225 from exiting the wireline head 200. In some examples, the main housing can be shaped to retain the rope socket 225.

FIG. 2B also shows that the inner cone 240 is retained by the inner housing 255. In particular, the inner cone 240 has a shoulder on the end which catches on the inner housing 255 as the rope socket assembly slides uphole. The shoulder catches on the inner housing which unseats the inner cone and allows the armors to slip from the rope socket 225 and for the cable to release from the wireline head 200. As such, the cable is freed is from the wireline head 200 with a clean release, while the various components of the wireline head 200 remain contained within the wireline head 200.

While the example of FIGS. 2A and 2B are described with respect to applying additional tension to the cable to cause the separable member 230 to break, the same functionality can be provided by a motor within the wireline head 200. For example, a motor can cause the separable member 230 to move in the same direction and distance as it moves due to breaking as a result of excessive tension, thereby accomplishing the same mechanical goal.

FIG. 3A is a cross-sectional illustration of a wireline head 300 that includes another separable mechanical link that includes a split nut. FIGS. 3A and 3B include a centerline 305 across which the drawn components are mirrored. The wireline head 300 of FIGS. 3A and 3B is similar to that of FIGS. 2A and 2B in that it includes a fixed block 340 that does not move relative to an attached tool, as well as a main housing 310 that is fixed to the block 340, such as by using a threaded connection or a threaded ring 360 as shown.

The wireline head 300 includes a rope socket 320 that can include one or more cones for retaining portions of a cable, such as the armor surrounding the cable. The rope socket 320 can include an inner cone 335 that includes a shoulder portion on the downhole side (i.e., right side when looking at FIG. 3A). The shoulder portion of the inner cone 335 is not in contact with other components in the operational position shown in FIG. 3A. The rope socket 320 can be secured on the uphole (i.e., left) side by a rope socket housing 315. As shown, the rope socket housing 315 can include a shoulder that contacts the rope socket 320.

The rope socket 320 is further secured by a split nut 325 and collar 330. A split nut 325 can be any type of fastener made from multiple pieces that, when held together, forms a fastener. The split nut 325 can thread to an outer surface of the rope socket 320. In this example, a collar 330 surrounds at least a portion of the split nut 325 to keep the various pieces together to form a functional fastener. However, without the collar 330 in place, the split nut 325 can separate into two or more pieces as discussed below. The collar 330 can also include, or be attached to, a blocking plate 355 that interfaces with the main housing 310. For example, the main housing 310 can include an inner shoulder that prevents the blocking plate 355 from moving uphole. The blocking plate 355 can include a cutout or aperture through which the rope socket housing 315 passes.

The rope socket housing 315 can include, or attach to, a separable member 345. In this example, the rope socket housing 315 is threaded to the separable member 345 at a connection point 350. The separable member 345 can be fixed to the block 340 at a downhole end. The separable member 345 can be configured to break at a lower tensile load than the other components of the wireline head 300 based on the material type, the shape or thickness of the component, or a combination thereof. The separable member 345 can also include a fastener, such as a pin, that is configured to fail at a predetermined tensile load. In the example of FIG. 3A, the separable member 345 includes a thin section configured to fail before the other components of the wireline head 300.

When tensile force is applied to a cable held by the wireline head 300, that force can be transferred through the rope socket 320 to the rope socket housing 315 based on their positioning. The rope socket housing 315, in turn, transfers the tensile load to the separable member 345. With sufficient tensile force, the separable member 345 can break as shown in FIG. 3B.

Once the separable member 345 breaks, the uphole portion of the separable member 345 can slide further uphole (i.e., left). This causes the attached rope socket housing 315 to slide uphole, along with the rope socket 320. For example, the cable retained in the rope socket 320 can pull both the rope socket 320 and rope socket housing 315 uphole until the rope socket 320 is trapped by the main housing 310, as shown in FIG. 3B. Meanwhile, the collar 330 and blocking plate 355 can retain their position based on the interference of the main housing 310 with the blocking plate 355. The collar 330, in turn, can retain the inner cone 335 in its position. This causes the inner cone 355 to separate from the rope socket 320, as shown.

In addition, as the rope socket 320 slides uphole, it can bring the split nut 325 with it via the threaded connection between the two. But because the collar 330 previously surrounding the split nut 325 does not slide uphole along with the rope socket 320, the collar 330 is removed from the split nut 325. This causes the split nut 325 to separate, releasing compression on the rope socket 320 and inner cone 335. This release of compression releases the trapped portions of the cable, allowing the cable to slide up hole and out of the wireline head 300. The wireline head 300 thereby provides a clean cable release while retaining all components of the wireline head 300.

While the example of FIGS. 3A and 3B are described with respect to applying additional tension to the cable to cause the separable member 345 to break, the same functionality can be provided by a motor within the wireline head 300. For example, a motor can cause the separable member 345 to move in the same direction and distance as it moves due to breaking as a result of excessive tension, thereby accomplishing the same mechanical goal. Similarly, the motor can accomplish the same goal by actuating the collar 330 surrounding the split nut 325.

Figure 4:
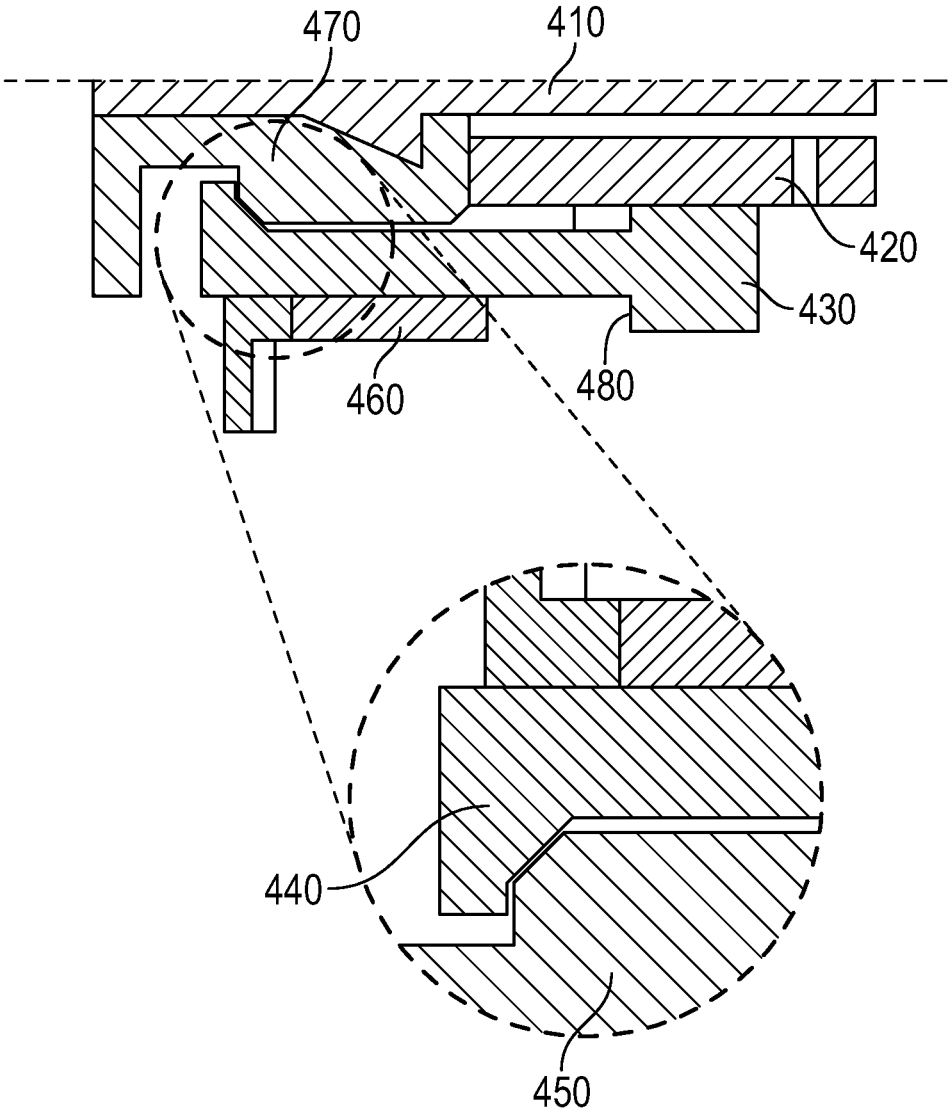
FIG. 4 is an illustration of an alternative embodiment of a portion of a wireline head that uses a collet rather than a split nut.

FIG. 4 provides an alternative embodiment to the wireline head 300 of FIGS. 3A and 3B, in which the split nut 325 is replaced by a spring finger collet 430. The drawing of FIG. 4 is a cross section with a centerline and an omitted half above the centerline for ease of discussion. The portions shown in FIG. 4 can be reflected above the centerline in a symmetrical manner. A portion 450 of the collet 430 catches on a profile 440 on the outer diameter of the rope socket 470. The downhole end of the collet 430 has a threaded internal profile. A jam nut 420 is threaded into the collet 430 to trap the inner cones. A sleeve 460 held in place in reference to the main housing, or the main housing, prevents the spring fingers of the collet from opening in normal operation. The assembly slides out of the sleeve 460 when the weak point of the separable member 345 is released. At that time the spring fingers open, the rope socket moves uphole (to the left in FIG. 4), a shoulder 480 on the spring finger collet 430 catches on the liner, and a shoulder on the inner cone catches on the jam nut 420, which cause the inner cone to separate from the outer cone 241 allowing the armors to release and the cable to separate from the head 300. A motor could also be used to activate the liner or push the collet to achieve the same mechanical function as the weak point breaking.

Additionally, a method is disclosed for operating the disclosed wireline heads. The method can include providing a wireline head as described, such as a wireline head with an outer cone (e.g., outer cone 241), an inner cone configured to trap a portion of the cable between the inner cone and outer cone, a mechanical link positioned within the wireline head, and a retaining component (e.g., retaining component 226) positioned to retain the cones after the mechanical link separates. The mechanical link can be configured to separate at a predetermined location such that the cable is freed from the wireline head.

The method can also include applying a tensile load to the cable, where the tensile load is sufficient to separate the mechanical link. The method can then include retrieving the cable from the wireline head. It can also include retrieving the wireline head and removing the cones from within it. In some examples, the wireline head can be reused by securing it to a tool and securing the cable back to the wireline head.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A wireline head comprising:

an outer cone;

an inner cone configured to trap a portion of a cable between the inner cone and the outer cone;

a separable member having a length oriented parallel to a centerline axis of the wireline head, the separable member being positioned within the wireline head and configured to separate at a predetermined position along its length when subjected to a predetermined tensile load;

a mechanical link positioned within the wireline head, wherein the mechanical link is configured to trap the inner and outer cones during normal operation and to release the inner and outer cones based on the separable member separating, such that the cable is freed from the wireline head; and a retaining component positioned to retain the inner cone within the wireline head after being released by the mechanical link.

2. The wireline head of claim 1, wherein the mechanical link is a metal collar.

3. The wireline head of claim 1, wherein the mechanical link is a split nut and sleeve.

4. The wireline head of claim 3, wherein the split nut separates into at least two pieces based on the sleeve sliding off the split nut.

5. The wireline head of claim 1, wherein the mechanical link is a spring finger collet, collet sleeve, and jam nut.

6. The wireline head of claim 1, wherein a first amount of force is required to separate the separable member, and wherein the first amount of force is smaller than a second amount of force required to break the cable or another component of the wireline head.

7. The wireline head of claim 1, wherein the mechanical link includes a sleeve, and wherein the sleeve is configured to allow for release of the inner cone.

8. The wireline head of claim 1, wherein the retaining component is a metal plate.

9. The wireline head of claim 8, wherein the metal plate is held in place by a screw.

10. A method for releasing a cable from a wireline head, the method comprising:

providing the wireline head, the wireline head having a centerline axis, the wireline head comprising:

an outer cone;

an inner cone configured to trap a portion of a cable between the inner cone and the outer cone;

a separable member having a length oriented parallel to the centerline axis of the wireline head, the separable member being positioned within the wireline head and configured to separate at a predetermined position along its length when subjected to a predetermined tensile load;

a mechanical link positioned within the wireline head, wherein the mechanical link is configured to trap the inner and outer cones during normal operation and to release the inner and outer cones based on the separable member separating, such that the cable is freed from the wireline head; and a retaining component positioned to retain the outer cone and inner cone within the wireline head after being released by the mechanical link; and applying a tensile load to the cable, wherein the tensile load is sufficient to separate the mechanical link; and retrieving the cable from the wireline head.

11. The method of claim 10, wherein the mechanical link is a metal collar.

12. The method of claim 10, wherein the mechanical link is a split nut and sleeve.

13. The method of claim 12, wherein the split nut separates into at least two pieces based on the sleeve sliding off the split nut.

14. The method of claim 10, wherein the mechanical link is a spring finger collet, collet sleeve, and jam nut.

15. The method of claim 10, wherein a first amount of force is required to separate the mechanical link, and wherein the first amount of force is smaller than a second amount of force required to break the cable or another component of the wireline head.

16. The method of claim 10, wherein the mechanical link includes a sleeve, and wherein the sleeve is configured to allow for release of the inner cone.

17. The method of claim 10, wherein the retaining component is a metal plate.

18. The method of claim 17, wherein the metal plate is held in place by a screw.

* * * * *